United States Patent [19]

Vocal

[11] Patent Number: 4,615,529

[45] Date of Patent: Oct. 7, 1986

[54] HUNTER'S ARROW

[76] Inventor: Rodolfo S. Vocal, P.O. Box 637, Mansfield, Ohio 44901-0637

[21] Appl. No.: 820,127

[22] Filed: Jan. 21, 1986

[51] Int. Cl.[4] ..... F41B 5/02

[52] U.S. Cl. ..... 273/421

[58] Field of Search ..... 273/416, 418–423

[56] References Cited

U.S. PATENT DOCUMENTS

| | | | |
|---|---|---|---|
| 2,212,345 | 8/1940 | Krieger | 273/421 X |
| 2,289,284 | 7/1942 | Chandler | 273/421 X |
| 2,568,417 | 9/1951 | Steinbacher | 273/421 |
| 2,796,691 | 6/1957 | Norris | 273/421 X |
| 3,036,395 | 5/1962 | Nelson | 273/419 X |
| 3,036,396 | 5/1962 | Swails | 273/419 X |
| 3,064,977 | 11/1962 | Zwickey | 273/419 |
| 3,417,994 | 12/1968 | Rohrbaugh, Jr. | 273/418 |
| 3,672,677 | 6/1972 | Moore | 273/416 |
| 3,759,519 | 9/1973 | Palma | 273/416 |
| 3,993,311 | 11/1976 | Johnson | 273/420 |
| 4,099,720 | 7/1978 | Zeren | 273/422 |
| 4,252,325 | 2/1981 | Weems et al. | 273/416 |
| 4,380,340 | 4/1983 | Simo | 273/416 |

*Primary Examiner*—Paul E. Shapiro

*Attorney, Agent, or Firm*—Oldham, Oldham & Weber Co.

[57] ABSTRACT

An arrow has a sectional shaft with forward, center and rear sections, at least the center section being tubular; a cord tied to the front and rear sections and extending through the center section to aid in retrieval of the arrow after it is shot; an arrowhead having a plurality of blades; a tail piece having a projection for snagging objects after the arrowhead has entered the body of an animal; a plurality of protective sheaths which cover the arrowhead blades in their closed position and which expose these blades in their open position; and at least one flap, pivotally mounted on the forward portion of the shaft for resisting removal of the arrowhead from an animal once it has entered therein.

5 Claims, 6 Drawing Figures

HUNTER'S ARROW

TECHNICAL FIELD

This invention relates to arrows used for hunting and particularly to arrows useful for deer hunting.

BACKGROUND ART

The bow and arrow has been used for hunting deer and other game animals since the early history of civilization and is still in use today. A problem with arrows now in use for this purpose is that often they do not fell the animal quickly and humanely. Instead, an animal may continue to run for a considerable length of time and distance after the arrowhead has entered the animal. In some cases the hunter may be able to follow a trail of blood left by the animal and thereby retrieve the animal after it has fallen; in other cases, if the animal's wound is no wider than the arrow shaft, there is little bleeding, and the hunter cannot sight the path of the animal, so that the hunter loses the animal and is unable to retrieve it after it has fallen.

The bow and arrow has also been used for fishing.

A number of arrows for hunting and fishing are described in patents and other published literature.

U.S. Pat. No. 2,289,284 Chandler, discloses an arrow having interchangeable arrowheads for game hunting, bird hunting and fishing. One form of the arrow, disclosed as being useful for fishing, includes a two-section shaft with a pair of pivoted barbs mounted on the front section, just behind the arrowhead, and a fishing line tied to both the front and rear sections. The rear section of the shaft is received in a tapered ferrule in the front section, so that the two sections may be disconnected. When the arrowhead has entered a fish, the barbs spread, and any pull on the fishing line tends to disconnect the two shaft sections.

Nelson, U.S. Pat. No. 3,036,395 discloses a fishing arrow having a plurality of barbs which spread after the arrow enters a fish, and a retrieving line tied to the shaft.

Swails, U.S. Pat. No. 3,036,396, discloses an arrow having spring loaded retractable barbs that are normally in their open or extended position, and which are retracted as the arrow strikes its target and then will become extended again after the forward end of the arrow has entered the animal.

Zwickey, U.S. Pat. No. 3,064,977, discloses an arrowhead having a spring member which becomes extended after the arrowhead has entered a fish or animal, and a cord to permit retrieval of the arrow after it is shot.

Palma, U.S. Pat. No. 3,759,519 discloses a telescoping arrow which includes an energy storing means which is released when the arrow enters an animal, thereby propelling the forward section of the shaft forward relative to the rear section.

Simo, U.S. Pat. No. 4,380,340 discloses a hunting arrow having a bleeder attachment to increase bleeding and thereby cause a faster and more humane death of the animal.

DISCLOSURE OF THE INVENTION

It is an object of this invention to provide a hunter's arrow, particularly useful for deer hunting, which will cause more rapid bleeding of the animal and therefore more humane death than is the case with conventional hunter's arrows.

It is a further object of this invention to provide a hunter's arrow which can be more readily retrieved than conventional arrows, once it has landed in an animal or has otherwise come to rest. These and other objects will be apparent from the specification which follows.

According to this invention, there is provided a hunter's arrow comprising a sectional shaft having separable forward and rear sections, and means for linking said sections after separation; an arrowhead comprising a plurality of blades; a tail piece having means for receiving a bow string and having at least one projection capable of snagging an object after the arrowhead has entered the body of an animal; a plurality of pivoted sheaths which in their closed position overlie the blades on the arrowhead and in their open position expose said blades; and at least one flap, pivotally mounted on the forward section of the shaft, for resisting removal of the arrowhead from an animal once it has entered therein.

The arrow preferably also has at least one additional flap which is pivotally mounted near the back end of the arrow, for snagging objects once the arrow has entered an animal.

BEST MODE FOR CARRYING OUT THE INVENTION

Figure 1:
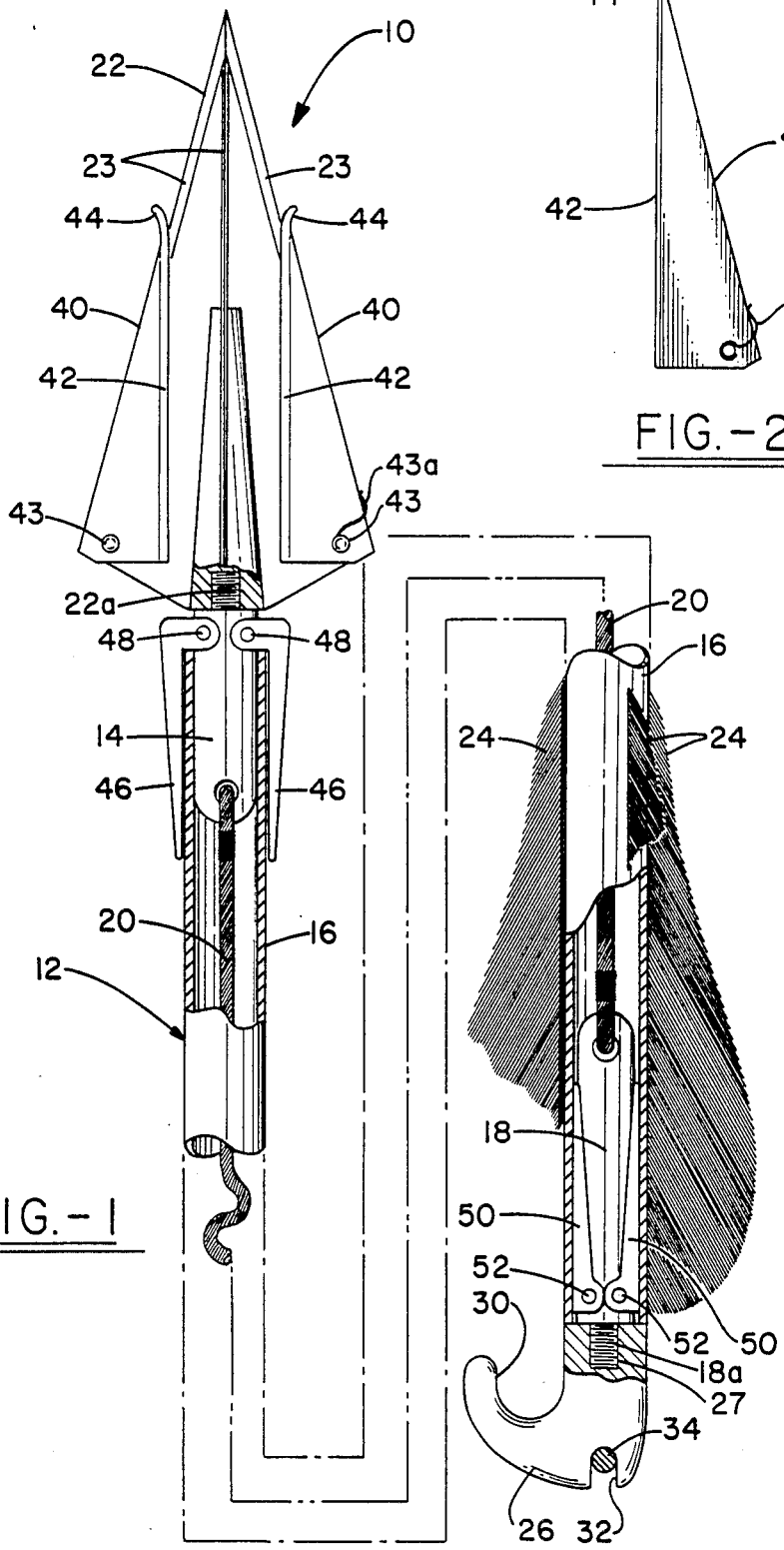
FIG. 1 is a front elevational view of a preferred arrow according to this invention, with all sheaths and flaps in their closed or retracted positions.
Figure 3:
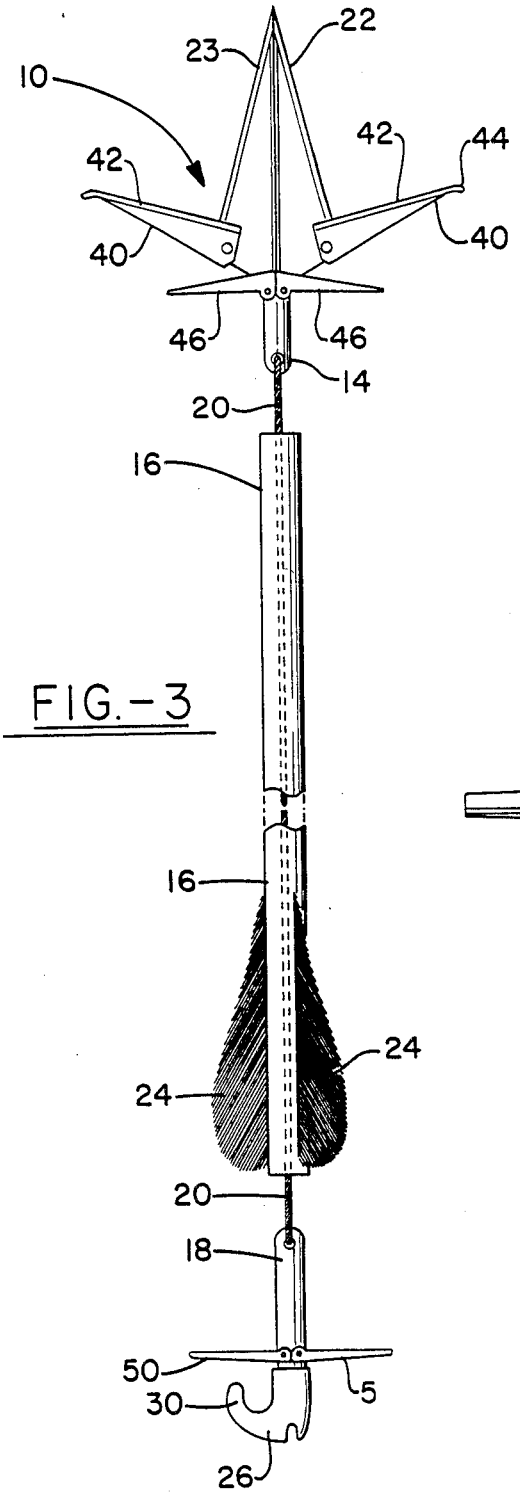
FIG. 3 is a elevational view, similar to FIG. 1, but with all sheaths and flaps in their open or extended positions.

Referring now to the drawings and especially to FIGS. 1 and 3, 10 indicates a hunter's arrow as a whole according to the preferred embodiment of this invention. Arrow 10 includes a sectional shaft 12 having a cylindrical forward section 14, a hollow tubular mid-section 16, and a cylndirical rear section 18. The mid-section 16 is made of metal, typically either stainless steel or aluminum and has an inside diameter just slightly larger than the outside diameters of forward section 14 and rear section 18. Forward section 14 and rear section 18 are also made of metal, typically either stainless steel or aluminum, and may be either solid or hollow, preferably solid. Front and rear sections 14 and 18 respectively, are slidably received in tubular mid-section 16 and fit snugly against the inside wall of tubular section 16. A flexible cord 20 of nylon or other suitable material is coiled up inside metal section 16 before the arrow is shot, so that the cord does not impede the flight of the arrow. The ends of cord 20 are tied or otherwise secured to the front section 14 and the rear section 18 of the shaft. Both sections 14 and 18 have eyelets to receive cord 20.

When the arrow 10 has been shot and lands in an animal, the front and rear sections, 14 and 18 respectively of shaft 12, (or at least one of these two sections)

will separate from the middle section 16 as shown in FIG. 3. This will be discussed in greater detail later. Cord 20 links front and rear sections 14 and 18, respectively, and thereby holds these two sections together after they have separated as shown in FIG. 3. The cord may be of considerable length if desired. This makes it possible for the hunter to retrieve the animal in which arrow 10 has landed.

An arrowhead 22 is attached to forward section 14 of shaft 12. Arrowhead 22 has a plurality of thin flat blades 23 (four are shown) which extend at intervals of 90° from a long tapering hub 23*a*. The arrowhead may be attached to the shaft by suitable means such as a screw threaded joint 22*a*. This may comprise, for example, a solid externally screw threaded tip on the forward end of shaft section 14 and an internally threaded socket on the arrowhead. Such a joint makes it possible to provide interchangeable arrowheads, so that the arrow may be used for both practice and for hunting, it may be used for hunting different species, such as fish, birds and small game, in addition to larger animals such as a deer.

A plurality of feathers 24 (three, for example) may be secured to the rear portion of center section 16 of shaft 12 to guide the arrow in flight. The feathers are optional and may be omitted; they normally will be omitted in arrows to be used for fishing. The feathers 24 are disposed at equal angles with respect to each other, (120° when three feathers are provided).

A tail piece 26 is attached to the rear section 18 of shaft 12 by suitable means such as the screw threaded joint 27 shown. This joint is formed by a rearwardly extending externally screw-threaded tip 18*a* of rear shaft section 18 and an internally threaded socket of tail piece 26. Tail piece 26 has a laterally extending hook or projection 30 for the purpose of snagging objects after the arrow has landed in a deer and the animal continues to run. Tail piece 26 also has a notch or nock 32 for receiving a bow string 34.

Figure 2:
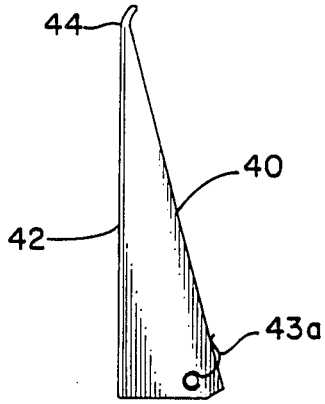
FIG. 2 is a detail elevational view of an arrowhead and sheath according to this invention.

Arrow 10 also has a plurality of sheaths 40, one for each blade 23 of arrowhead 22. Each of these sheaths is of generally U-shaped cross section with sharp edges 42 which form blades. Each sheath 40 is pivotally mounted on its arrowhead blade 23 by means of a pivot pin 43 which is located near the trailing edges of sheath 40 and blade 23. A leaf spring 43*a* (See FIG. 2), which is coiled around pivot pin 43, normally holds the sheath in the closed position shown in FIG. 1. Each sheath 40 also has an outwardly curved forward tip 44 (best seen in FIG. 1) which will cause the sheath 40 to be rotated to the open position (shown in FIG. 3) once the arrowhead 22 has entered an animal. This exposes sharp edges 42.

A pair of flaps 46 are pivotally mounted 180° apart on the forward portion 14 of shaft 12. Pivot pins 48 are provided for this purpose. Flaps 46 rotate forwardly from a retracted or closed position, shown in FIG. 1 to an open or extended position, shown in FIG. 3, when the forward portion of arrow 10 enters an animal. These flaps prevent the arrowhead 22 and forward shaft section 14 from being pulled out of the animal, once it has entered therein, or at least tend to resist the pulling out of arrowhead 22 and forward shaft section 14.

Figure 5:
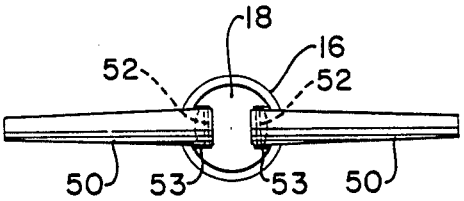
FIG. 5 is a rear view of the arrow with the rear flaps open and the arrowhead and the tail piece removed.
Figure 4:
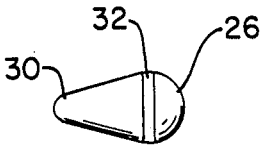
FIG. 4 is a rear view of the tail piece.

Arrow 10 also has one or more rear flaps 50, which are pivotally mounted on the rear section 18 of shaft 12 by means of pivot pins 52. Preferably there are two rear flaps 50 which are 180° apart, as best seen in FIG. 5. These rear flaps 50 are arcuate in cross section, corresponding to the cylindrical curvature of rear section 18 of shaft 14. Rear flaps 50 are pivoted to open rearwardly as shown in FIG. 3. Rear shaft section 18 may have notches 53 to provide flat surfaces for the heads of pivot pins 52.

Rear flaps 50 provide additional surfaces for snagging trees and branches, once the arrow 10 has come to rest inside an animal. Any upward inclination of arrow 10 will result in opening of rear flaps 50 to the position shown in FIG. 3. These flaps in the open position provide additional surfaces for snagging tree branches and bushes.

Cord 20, forward flaps 46 and rear flaps 50 must all be able to withstand the full weight of an adult male deer. Ability to withstand a force of 300 pounds is sufficient. It is not necessary for the hook 30 on tail piece 26 to be this strong, since the rear flaps 50 are still available for snagging objects.

Figure 6:
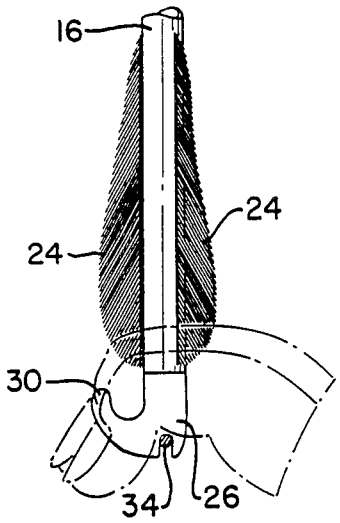
FIG. 6 is a top view of the arrow showing how an archer would position the arrow between his index finger and middle finger (shown in phantom lines) in order to shoot the arrow.

To shoot an arrow, the hunter places the nock 32 of tail piece 26 against the bowstring 34 with the hook 30 horizontal and toward the hunter's finger tips, as shown in FIG. 6. Hook 30 extends away from the bow, i.e. to the left if the hunter is right handed and to the right if the hunter is left handed, in order to avoid interference between hook 30 and the bow.

At the time of delivery to the user, all sheaths 40 and all flaps 46 and 50 are in the closed position as shown in FIG. 1. The sheaths and flaps remain in this position after the arrow has been shot and while it is in flight. When the arrow strikes an animal, a portion of the arrow, say the arrowhead 22 and a portion of shaft 12, will penetrate the animal. As the forward tips 44 of sheaths 40 strike body tissues (e.g. bone or muscle), the rounded contour of these tips causes sheaths 40 to open to the position shown in FIG. 3 against the bias of spring 43*a*. This exposes blades 23 of arrowhead 22 and blade surfaces 42 of sheath 40. The multiplicity of cutting surfaces results in rapid bleeding of the animal so that death follows quickly, before the animal runs a great distance. As the animal runs through woods or bushes, the hook 30 on tail piece 26 and flaps 50 on rear shaft section 18, will likely snag tree branches or bushes. This will cause the front, middle and rear shaft sections 14, 16 and 18, respectively, to separate, and cord 20 to become uncoiled until it is fully taut, as shown in FIG. 3. Even though the hunter may lose sight of the animal, he will most likely spot the tail piece 26 and the cord 20 and will be able to retrieve the animal where it has fallen. If cord 20 becomes fully extended and taut before the animal falls, further running by the animal will back the arrow 10 somewhat from its deepest penetration inside the animal. As the arrow is pulled back, flaps 46 will strike body tissue (e.g., organs, muscle, bones or skin) and will be caused to open to the position shown in FIG. 2 if they have not already become opened by gravity. If the extended flaps 46 encounter soft tissue as the arrow 10 is pulled back, these flaps will cause further tissue damage, which will hasten the death of the animal. If the extended flaps 46 encounter hard tissues, such as bones, further forward movement of the animal is arrested unless hook 30 or rear flaps 50 become disengaged.

Various modifications can be made without departing from the scope and spirit of the invention. For example, rear flaps 50 may be mounted on the tail piece 26 or may even be omitted entirely without changing the basic mode of operation of the invention. According to another modification, one may provide a series of arrowheads for different purposes. For example, in addition to the arrowhead shown, which is particularly suitable for shooting deer, one may also provide a blunted arrowhead for practice, and optionally other arrowheads for hunting other animals or for fishing. Also, the arrow of this invention may be made in whatever size is appropriate for the desired purpose; for example, the arrow may be made in a smaller size for rabbit hunting and a larger size for deer hunting.

Arrows according to the present invention are safer to carry and to use than are conventional arrows for deer hunting, because the sheaths 40 in their closed position (FIG. 1) protect the hunter from accidental cutting by blades 23 on arrowhead 22. Blades 42 on these same sheaths 40 result in faster bleeding and therefore quicker and more humane death of the animal than would be the case with a conventional arrow having only arrowhead 22 and its associated cutting surface. Another problem encountered with conventional arrows is the difficulty in tracking an animal, particularly if the animal runs a great distance after it is shot. Cord 20 makes it much easier to track and retrieve the animal than is the case with the conventional arrow.

A further advantage of the arrow according to this invention is that much of it is reuseable. While the arrowhead 22 and the forward portion 14 of shaft 12 will most likely remain inside the animal, therefore be used only once, the remainder of the arrow 10 can be retrieved and reused. To this end, one must untie cord 20 from forward section 14 and recoil the cord inside the center section 16 of shaft 12. One then needs only to supply a new arrowhead 22 and a new forward section 14 of shaft 12 and assemble these parts with the existing center section 16, rear section 18, cord 20, and tail piece 26.

While in accordance with the patent statutes, a preferred embodiment and best mode has been presented, the scope of the invention is not limited thereto, but rather is measured by the scope of the attached claims.

What is claimed is:

1. A hunter's arrow comprising (a) a sectional shaft having separable forward and rear sections, and means for linking said sections after separation;

(b) an arrowhead comprising a plurality of blades, (c) a tail piece having means for receiving a bowstring and having at least one projection capable of snagging an object after the arrowhead has entered the body of an animal;

(d) a plurality of pivoted sheaths which in their closed position overlie the blades on the arrowhead and in their open position expose said blades; and (e) at least one flap pivotally mounted in the forward section of said shaft, said flap in its open position resisting removal of the arrowhead from an animal once the arrowhead has entered an animal.

2. A hunter's arrow according to claim 1 including at least one additional flap, said additional flap being pivotally mounted near the back end of the arrow.

3. A hunter's arrow according to claim 2 in which said additional flap is mounted on the rear section of said shaft.

4. A hunter's arrow according to claim 1 in which said means for linking said section of said shaft after separation is a cord secured to said forward and rear sections and extending through said center section.

5. A hunter's arrow according to claim 1 in which said sheaths have sharp edges which are exposed when said sheaths are in their open position.

* * * * *